United States Patent [19]

Polvere

[11] Patent Number: 4,836,390

[45] Date of Patent: Jun. 6, 1989

[54] RACK FOR DISPENSING ARTICLES

[76] Inventor: Dennis J. Polvere, 151 Prospect Ave., Apt. 15C, Hackensack, N.J. 07601

[21] Appl. No.: 108,763

[22] Filed: Oct. 15, 1987

[51] Int. Cl.[4] ..... A47F 1/00

[52] U.S. Cl. ..... 211/59.3; 211/51

[58] Field of Search ..... 211/54.1, 59.3, 51

[56] References Cited

U.S. PATENT DOCUMENTS

| | | | |
|---|---|---|---|
| 3,007,580 | 11/1961 | Dickson, Jr. . | |
| 3,161,295 | 12/1964 | Chesley | 211/59.3 |
| 3,780,873 | 12/1973 | Silva . | |
| 4,303,162 | 12/1981 | Suttles | 211/59.3 |
| 4,724,968 | 2/1988 | Wombacher | 211/59.3 |
| 4,742,936 | 5/1988 | Rein | 211/59.3 X |
| 4,836,710 | 6/1983 | Dauman . | |

FOREIGN PATENT DOCUMENTS

| | | | |
|---|---|---|---|
| 2385365 | 12/1978 | France | 211/59.3 |
| 35581 | 11/1970 | Japan | 211/59.3 |

*Primary Examiner*—Robert W. Gibson, Jr.

*Attorney, Agent, or Firm*—Jay H. Maioli

[57] ABSTRACT

A rack for dispensing articles includes a compartment divided into longitudinal channels, each channel including a pusher for urging articles towards the front of the compartment. Each pusher rides along a longitudinal slot in the bottom wall of the compartment and has an upper pusher body within the compartment and a lower foot portion below the bottom wall. A biasing spring tips each pusher so that the foot portion makes contact with the bottom wall substantially along a line at the rear edge of the foot portion to prevent jamming or cocking of the pusher during motion along the slot. In order to easily fill the rack, the compartment is mounted on a base and is slidable forwardly of its normal position while at the same time all the pushers are held fixed relative to the base, thereby providing openings at the front of the channels to insert articles. A two step lock holds the compartment at its normal position on the base, but when the lock is manually actuated, the compartment becomes disengageable from the base and may thereafter be manually disengaged from the base.

9 Claims, 4 Drawing Sheets

RACK FOR DISPENSING ARTICLES

BACKGROUND OF THE INVENTION

Racks for displaying and dispensing articles such as toothbrushes and lipsticks are well known and come in a large variety of shapes and constructions. Advantageously the articles are stacked vertically or on a slope, with the article to be dispensed at a frontmost or bottom position, hereinafter referred to as the dispensing position, at which it may be removed from the rack. When the article to be dispensed is intrinsically heavy, such as a can of soda, the articles can be stacked up and the frontmost article urged by its own weight and the weight of the articles above it towards the dispensing position. When the article is lightweight, however, it may be necessary to add some means for urging or pushing the articles towards the dispensing position. This pusher means must supply sufficient force to ensure that the articles are pushed to the front of the dispenser while allowing the articles to be loaded into the dispenser in front of the pusher means. Thus, when a weight is placed behind the articles for this purpose, it must be heavy enough to push the articles effectively while being light enough to be displaced backwards to allow loading.

A third and highly significant consideration is that the pusher means continue to exert the forward force along the entire extent of the rack. If this ceases to happen, the pusher will fail to exert any force on the remaining articles, which may therefore not be moved to the dispensing position. For example, if the pusher means is designed to move along a track, it very important to prevent it from jamming or cocking by sideways turning along the track.

Furthermore, when articles are stacked vertically or along a descending slope, it is important to ensure that neither the articles nor any portion of the rack itself become free to fall, for example during a loading operation to insert articles into the rack.

OBJECTS AND SUMMARY OF THE INVENTION

It is an object of the present invention to provide a rack for dispensing articles which avoids the above-described difficulties of the prior art.

It is a further object of the present invention to provide a rack for dispensing articles including pushers for urging individual channels of articles toward a dispensing position, wherein the pushers will not jam or cock during the dispensing operation.

It is yet a further object of the present invention to provide such a rack for dispensing articles in which all the pushers are automatically held during a loading operation so that a space in front of the pushers is created for insertion of articles therein.

It is still a further object of the present invention to provide such a rack for dispensing articles in which the articles and the rack itself are prevented from falling during the loading operation.

In accordance with the present invention, a rack for dispensing articles comprises a substantially rectangular compartment having front, rear, bottom and opposed side walls, at least one divider wall section extending longitudinally between the front and rear walls for dividing the compartment into a plurality of longitudinal channels, a longitudinal slot in each of the channels extending through the bottom wall, and pusher means movable longitudinally in each of the channels for urging articles within the respective one of the channels in a forward direction towards the front wall, each pusher means including an upper pusher body within the respective channel adapted to bear against a rearmost article in the channel and having a lower surface, a lower foot portion below the bottom wall having an upper surface spaced from the lower surface of the pusher body by a distance greater than a thickness of the bottom wall, a connecting element extending through the respective slot for connecting the pusher body and the foot portion, and biasing means for urging the pusher means in the forward direction and acting above the lower surface thereof to tip the pusher body and thereby bring a rear portion only of the foot portion into substantially line contact with the bottom wall.

The above and other objects and advantages of the present invention will be apparent from the following detailed description of a preferred embodiment thereof, taken in conjunction with the accompanying drawings throughout which like reference numerals designate like elements and parts.

DETAILED DESCRIPTION OF THE PREFERRED EMBODIMENT

Figure 1:
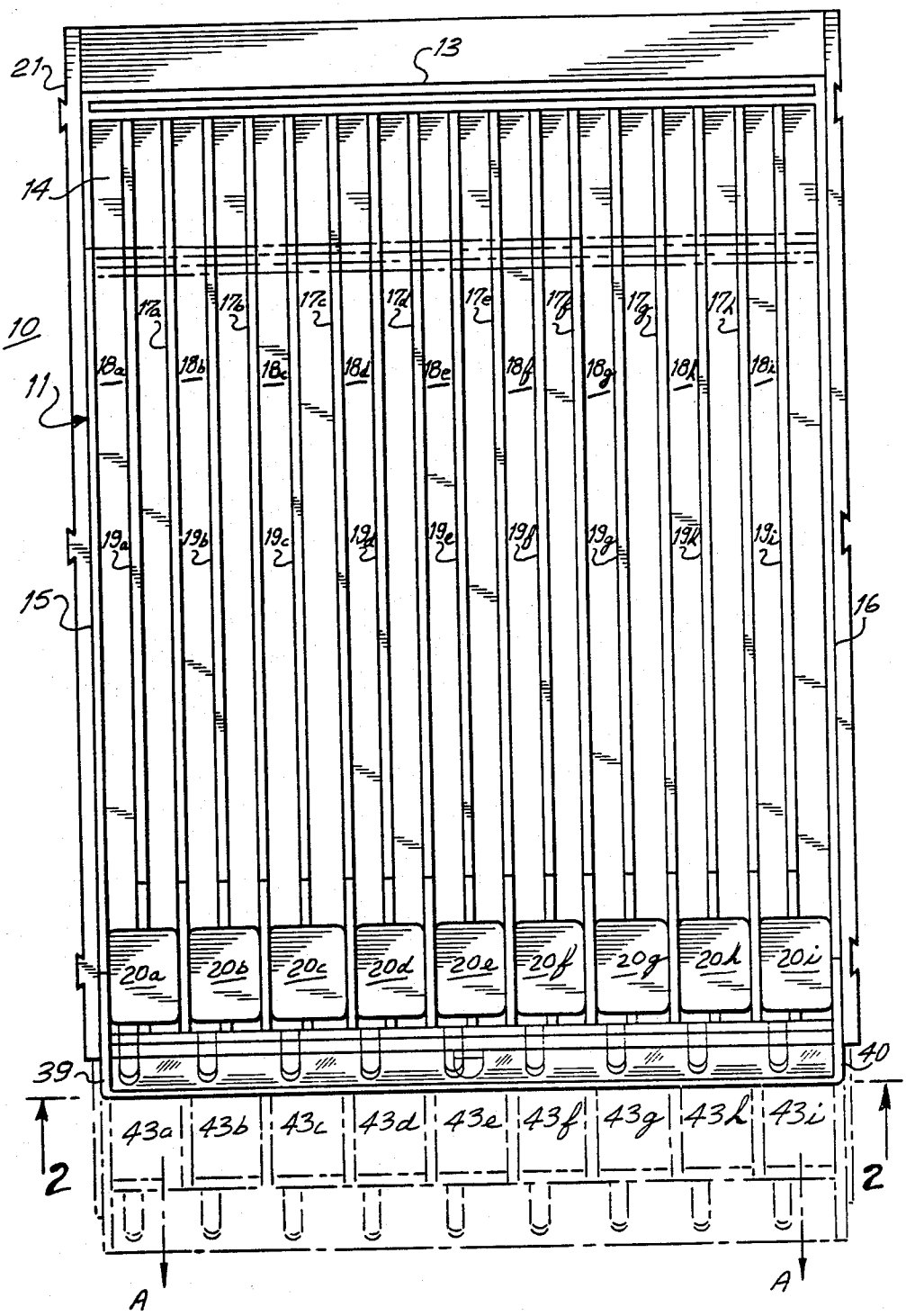
FIG. 1 is a top plan view of a preferred embodiment of a rack for dispensing articles according to the present invention.
Figure 2:
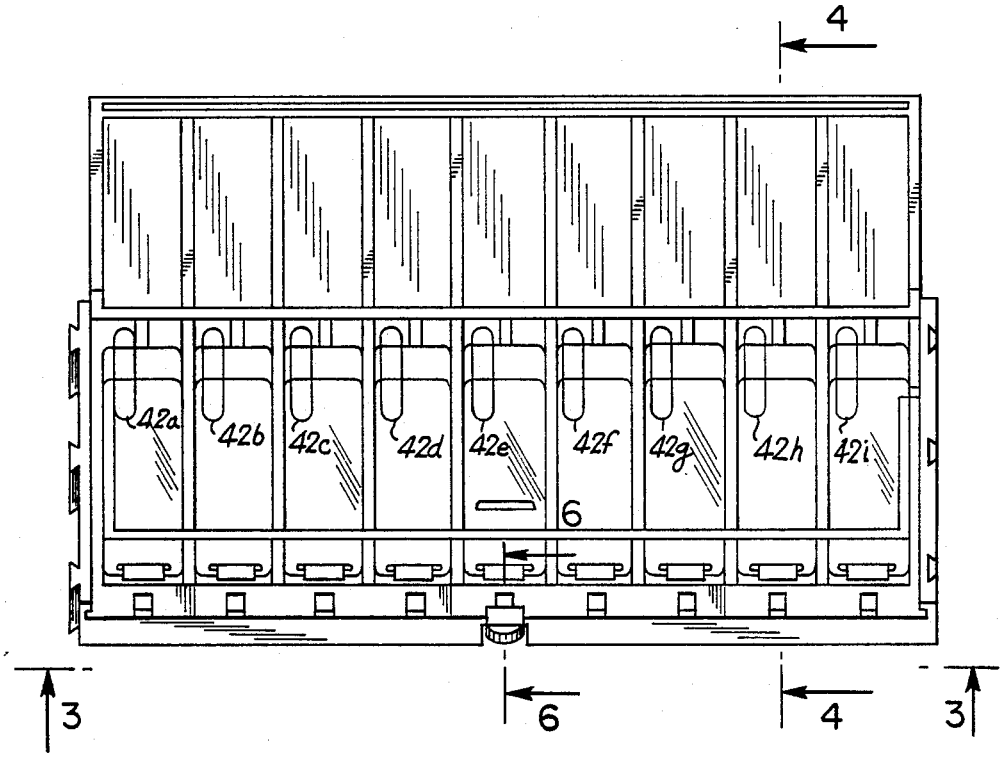
FIG. 2 is a front elevational view taken in the direction of arrows 2—2 in FIG. 1.
Figure 3:
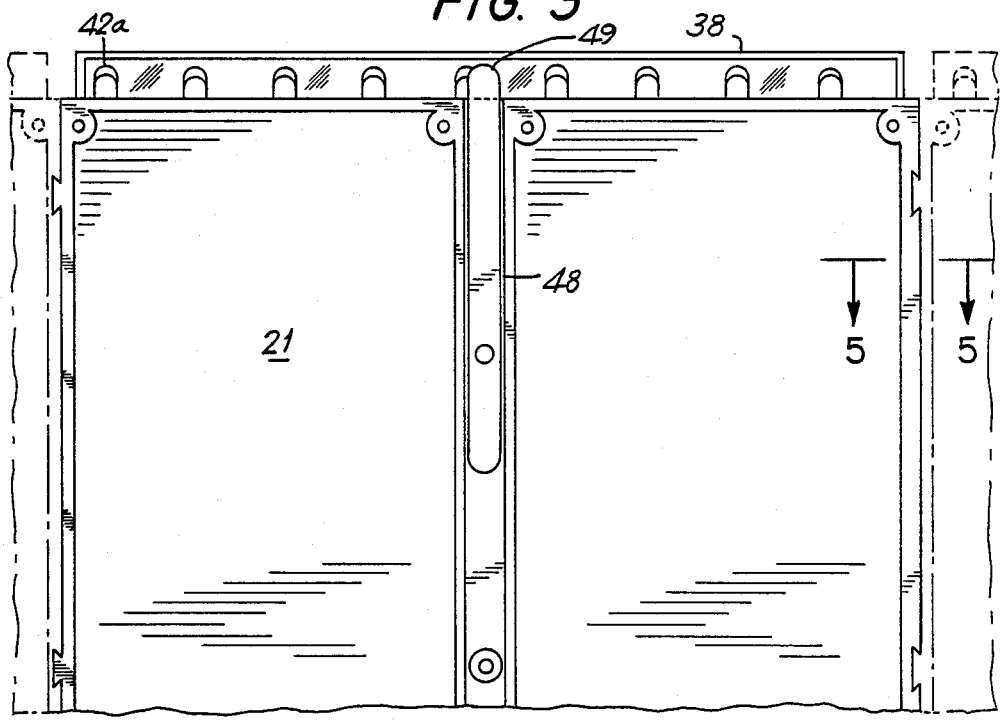
FIG. 3 is a bottom elevational view taken in the direction of arrows 3—3 in FIG. 2.

Referring now to the drawings, and initially to FIG. 1 thereof, a rack 10 according to the present invention is formed as a substantially rectangular compartment 11 having a front wall 12, a rear wall 13, a bottom wall 14, and left and right opposed side walls 15, 16. Eight divider wall sections **17*a*–17*h* extend longitudinally between front and rear walls 12, 13 parallel to side walls 15, 16 and perpendicular to bottom wall 14 to divide compartment 11 into nine longitudinal channels 18*a*–18*i*. Sections 17*a*–17*h* may be separable from compartment 10 for assembly and disassembly. Of course, the particular number of channels is a matter of design choice and may be increased or decreased. Each channel 18*a*–18*i* is adapted to store and dispense an individual column of articles and includes an advantageous and independent pusher means for urging the articles stored therein toward the respective dispensing position at the front of the channel. Since all channels 18*a*–18*i* are identical in construction and operation, the following description with specific reference to channel 18*a* only. It will be understood, however, that the detailed description given with respect to channel 18*a* is equally applicable to all of the remaining channels 18*b*–18*i***.

Running the length of channel **18*a* is a longitudinal slot 19*a* extending through bottom wall 14. Longitudinal slot 19***a* is advantageously centered in channel 18*a* in the widthwise direction thereof and serves to guide a pusher 20*a* which is movable longitudinally along slot 19*a* in channel 18*a* for urging articles placed between pusher 20*a* and front wall 12 towards front wall 12 in a forward direction indicated by arrows A in FIG. 1. For the purpose of clarity, rack 10 has been illustrated empty of articles such as toothbrushes and the like. It should be understood, however, that when pusher 20*a* is displaced backwards away from front wall 12, a space between pusher 20*a* is created into which articles may be inserted for displaying and dispensing. As described in more detail below, pusher 20*a* is designed to urge the articles in the forward direction so that the frontmost article will always abut front wall 12. This position abutting front wall 12 is the dispensing position at which articles may advantageously be removed from rack 10.

Compartment 11 is mounted on a lower support base 21 at a predetermined normal position thereon and is slidably movable in the forward direction of arrows A relative to base 21 to permit the loading of articles into channels 18*a*–18*i* during a loading operation. A forward position of compartment 11 after having been moved in the forward direction from its normal position is illustrated in phantom in FIG. 1. As will be discussed in more detail below, pusher 20*a* is prevented from moving forward beyond its own normal position when compartment 11 is at its normal position and is held fixed relative to base 21 during further forward movement of compartment 11 to create an empty space 22*a* in front of pusher 20 during the loading operation. All pushers 20*a*–20*i* are automatically so held at their respective normal positions.

Figure 4:
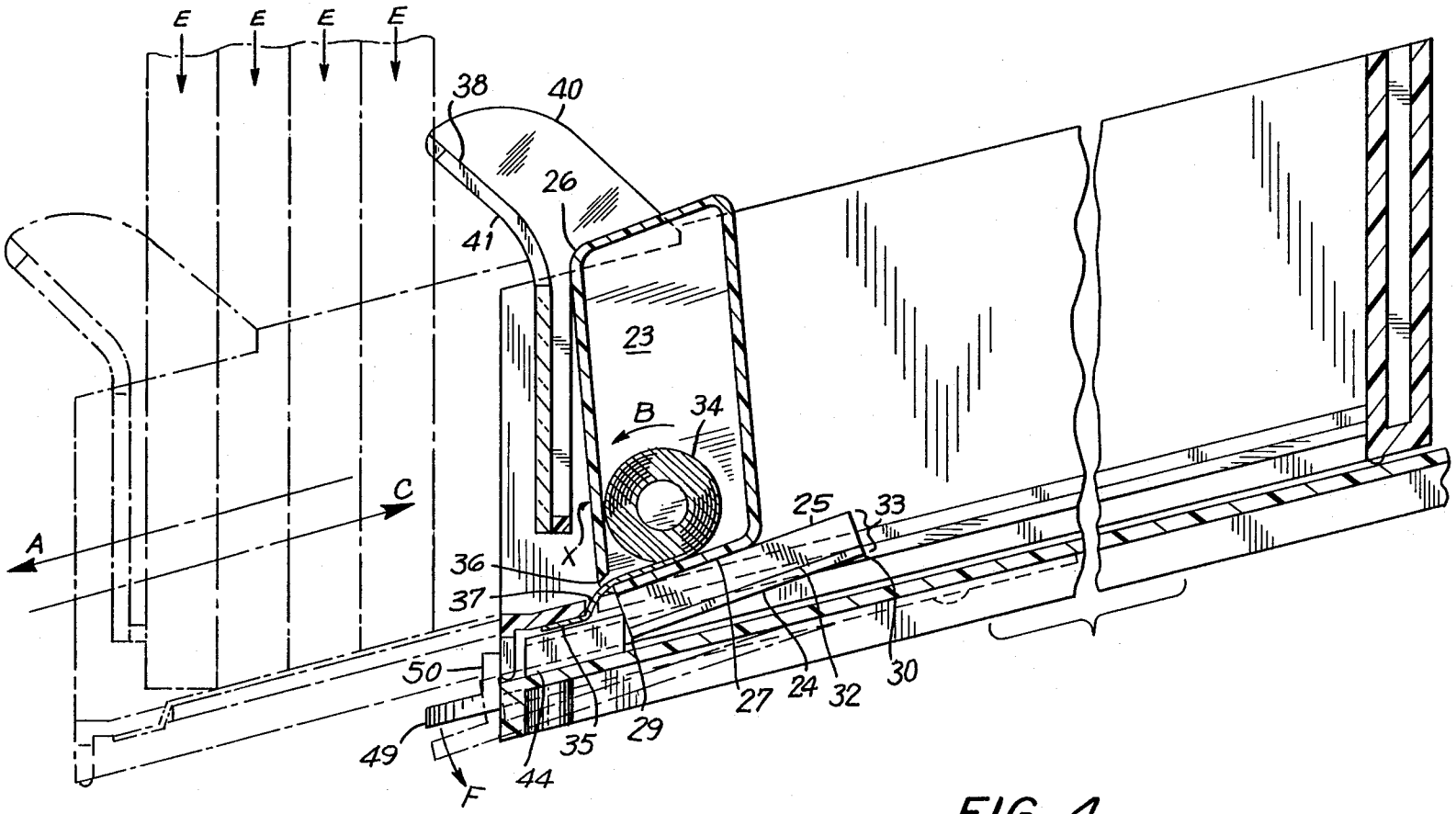
FIG. 4 is a side cross-sectional view taken in the direction of arrows 4—4 in FIG. 2.
Figure 7:
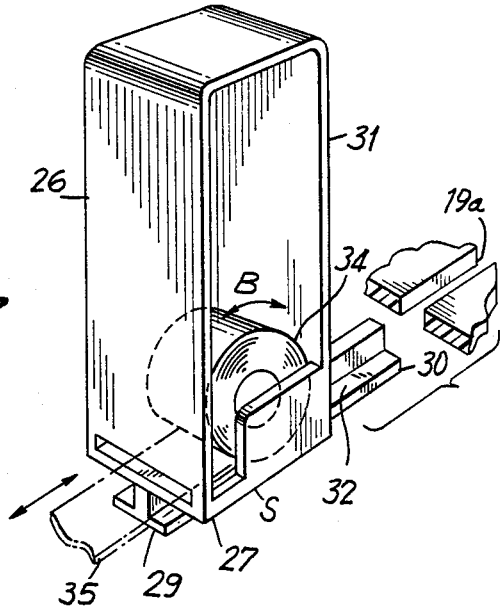
FIG. 7 is an elevational view of a pusher and track of the rack according to the present invention.

Pusher 20*a* forms an important part of the present invention and, as may be seen more clearly in FIGS. 4 and 7, includes an upper pusher body 23, a lower foot portion 24 and a connecting element 25 for connecting the two. Upper body 23 is advantageously formed as a hollow body having a height approximately equal to, and advantageously no higher than, the height of left and right side walls 15, 16, and divider wall sections 17*a*–17*h*. Pusher 23 has a smoothly rounded front/top surface 26 to facilitate the sliding insertion of articles in front of pusher body 23 and a lower surface 27 adapted to slide smoothly along bottom wall 13. The hollow cavity of pusher body 23 contains a biasing structure in the form of a spring roll 28 freely disposed therein which advantageously serves both to provide the forward urging force of pusher 20*a* and also biases pusher 20*a* for sliding movement along slot 19*a* without cocking or jamming. In order to insert spring roll 28 into pusher body 23, at least one side wall S of pusher body 23 is of a size only large enough to hold spring roll 28 inside when it lies on lower surface 27. The other side wall must also be at least this large, but may be complete.

In the preferred embodiment, foot portion 24 is formed as a substantially rectangular plate having a length in the longitudinal direction at least as large as the length of pusher body 23 itself and, as shown FIGS. 4 and 7, may have a front edge 29 aligned with front surface 26 of pusher body 23 and a rear edge 30 extending up to or beyond a rear wall 31 of pusher body 23. Foot portion 24 also has an upper surface 32. In the preferred embodiment, connecting element 25 is also a substantially rectangular plate having a width adapted to be slidingly received in slot 19*a* and having a height 33 greater than the thickness of bottom wall 14 by a predetermined distance. Foot portion 24 and connecting element 25 together form an inverted T-shape element extending below lower surface 27 of pusher body 23. Connecting element 25 may have a length equal to that of foot portion 24, or may have a reduced length provided it remains long enough to prevent any significant turning of pusher body 23 from side to side.

In accordance with an important aspect of the present invention, height 33 provides a clearance distance between lower surface 27 of pusher body 23 and upper surface 32 of foot portion 24. This clearance distance permits pusher 20*a* to be tipped in the forward direction so that only rear edge 30 of foot portion 24 is normally in contact with the lower surface of bottom wall 14 during sliding motion of pusher 20*a* in channel 19*a*. That is, foot portion 24 is in substantially line contact only with bottom wall 14 at a rear portion thereof.

In order to tip pusher 20*a*, spring roll 28 has a rolled portion 34 disposed within pusher body 23 and an end 35 attached to compartment 11 at the front of channel 19*a*. In illustrated embodiment, end 35 extends out through a slot 36 at the front lower corner formed by of lower surface 27 and front surface 26 of pusher body 23, and then extends through a second slot 37 in bottom wall 14 so as to be fastened to the lower surface of bottom wall 14. Rolled portion 34 bears against front surface 26 of pusher body 23 at a point X above lower surface 27 and has a tendency to roll up in the direction of arrow B in FIG. 4. This achieves two separate effects. First, the tendency of spring roll 28 to roll up will cause rolled portion 34 to exert the forward force to urge pusher 20*a*, and any articles disposed in front thereof, to move along slot 19*a* toward front wall 12. Secondly, because rolled portion 34 exerts this force above lower surface 27, it thereby exerts a tipping action on pusher body 23 to tip it onto its front lower corner adjacent slot 36. As a consequence of this tipping action, foot portion 24 is also tipped so that only rear edge 30 normally rides against the lower surface of bottom wall 14 in substantially line contact.

Advantageously, spring roll 28 has a spring tension selected in consideration of the weight of the articles to be dispensed so as to exert sufficient force in the direction of arrows A to bring the foremost article to the dispensing position, while such forward force may be easily overcome by a force exerted in the direction of arrow C, either manually when individual articles are inserted one at a time or automatically by a latch on base 21 during a loading operation, as will be described in more detail below.

This limited contact of foot portion 24 at the rear edge 30 thereof is highly advantageous. It has been found that by providing only substantially line contact at a rear portion of foot portion 24, as opposed to sliding foot portion 24 along its entire surface against bottom wall 14, pusher 20*a* will not jam or cock during its sliding motion along slot 19*a*. As stated above, it is critical in the dispensing of lightweight articles, such as toothbrushes, that pusher 20*a* exert a constant forward force to present each article in turn at the dispensing position. If the articles are not moved fully to the dispensing position, it may be difficult or even impossible for a consumer to remove the foremost article for purchase. Even such an apparently minor problem in removing the articles from a dispenser has been found to be a significant factor in discouraging purchasers. The apparatus according to the present invention, in ensuring the smooth sliding motion of pusher 20*a* along slot 19*a*, removes this difficulty found in the prior art.

As shown in FIG. 4, front wall 12 has upper curved surface 38 curving forwardly and away from compartment 11. Right and left side walls 15, 16 include corresponding ears 39, 40 adjacent curved surface 38. After a customer removes an article from channel 18*a*, he may decide not to purchase and wish to return the article back into channel 18*a*. Curved surface 38 facilitates this process by allowing the article to be slid therealong so as to engage and backwardly displace the remaining articles and pusher body 23 against force of spring roll 28 in the direction of arrow C of FIG. 4. Advantageously, this curved surface 30 has a window 41 formed of clear plastic or glass to facilitate a view of the articles held within the dispenser and may also include slots 42*a*–42*i* aligned with channels 18*a*–18*i*. Further, a hinged door (not illustrated) may be provided to cover information, such as the Universal Product Code, which is unnecessary or undesirable for display to purchasers.

Rack 10 for dispensing articles according to the present invention is constructed for a highly advantageous loading operation, as will now be described. When it comes time to restock rack 10, it is anticipated that a number of channels 18*a*–18*i* may have become depleted of articles. Rather than requiring each pusher 20*a* to be individually displaced backwards to enable articles to be inserted therein, compartment 11 may be slid forwardly from its normal position on base 21 while all pushers 20*a*–20*i* are automatically held to move no further than their normal position shown in FIG. 1 and are thereafter held fixed relative to base 21 so as to present an empty space 43*a*–43*i* ahead of pushers 20*a*–20*i* for all channels 18*a*–18*i* simultaneously. If all channels 18*a*–18*i* contain no or an equal number of articles, the spaces 43*a*–43*i* created in front of pusher bodies 23*a*–23*i* will be equal. However, even if the number of articles in the respective channels 18*a*–18*i* are unequal, each channel will nevertheless present a space for the insertion of articles unless the channel is already completely filled.

As may be seen best in FIG. 4, when compartment 11 is moved forwardly in the direction of arrow A, pusher 20*a* will move forward with compartment 11 until front edge 29 of foot portion 24 contacts a latch element in the form of an upstanding tab 44 (FIG. 5) projecting upwardly from base 21. Tab 44 thus defines the normal position of pusher 20*a* shown in FIG. 1. Tab 44 is aligned with and advantageously projects into slot 19*a* and, as illustrated in FIG. 4, is positioned at the front of channel 18*a*. As compartment 11 continues to move forward, end 35 of spring roll 28 will move forward with base wall 14, causing spring roll 28 to unroll in the direction opposite arrow B of FIG. 4 and enabling pusher 20*a* to slide backwards in the direction of arrow C in slot 19*a*. Thus, pusher 20*a* will move in the forward direction up to the position determined by tab 44 and will move no further, being thereafter held during fixed relative to base 21 further sliding movement of compartment 11 in the forward direction. For example, if compartment 11 were completely empty, as illustrated in FIG. 1, and were moved forward to the position illustrated in phantom, pushers 20*a*–20*i* would nevertheless remain in the positions illustrated in FIG. 1.

As a result, when compartment 11 has been moved to a forward position for loading, as illustrated in phantom in FIGS. 1 and 4, articles may be vertically inserted in the direction of arrows E to load rack 10. It will be understood, of course, that compartment 11 may be moved forward by any desired distance to permit the loading of more or fewer articles as desired. When the loading operation is complete, compartment 11 is slid backwardly in the direction of arrow C, while pusher 20*a* is maintained in its forward position by roll-up of spring roll 28 until front wall 12 contacts the rearmost article loaded into channel 18*a*. Further movement of compartment 11 in the backward direction will then result in corresponding backward motion of pusher 20*a* and unrolling of spring roll 28. As stated above, the loading of spring roll 28 is selected so as to provide sufficient forward force against the articles to move them successively to the dispensing position, while permitting the rearward motion during completion of the loading operation without requiring the use of successive force.

Figure 5:
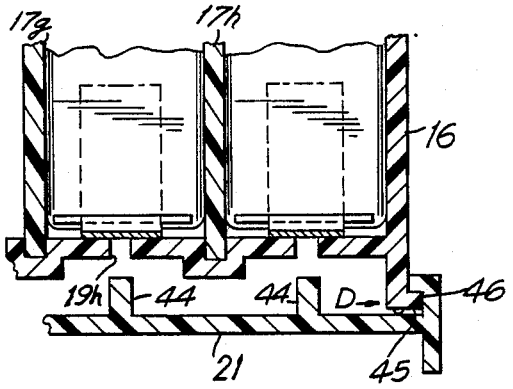
FIG. 5 is a cross-sectional view taken along arrows 5—5 FIG. 3.

As shown in FIG. 5, compartment 11 is mounted for sliding movement on base 21. Specifically, right side wall 16 includes a lower side flange 45 adapted to be slidingly received in a channel 46 formed by an upwardly projecting side flange 47 on base 21. Left side wall 15 is a mirror image of right side wall 15, and will be understood to include a corresponding lower side flange 45 slidingly received in a channel 46 created by an upper side flange 47 of base 21. As shown in FIG. 5, channel 46 has a height greater than the thickness of lower side flange 45 by a predetermined clearance distance D, thus allowing compartment 11, normally riding on the upper surface of bottom wall 14, to be manually lifted therefrom by the predetermined clearance distance D. This predetermined clearance distance D provides a highly advantageous, two step locking system whereby compartment 11 may be moved forward for loading without the risk of accidental falling of compartment 11 from base 21 by misoperation.

Figure 6:
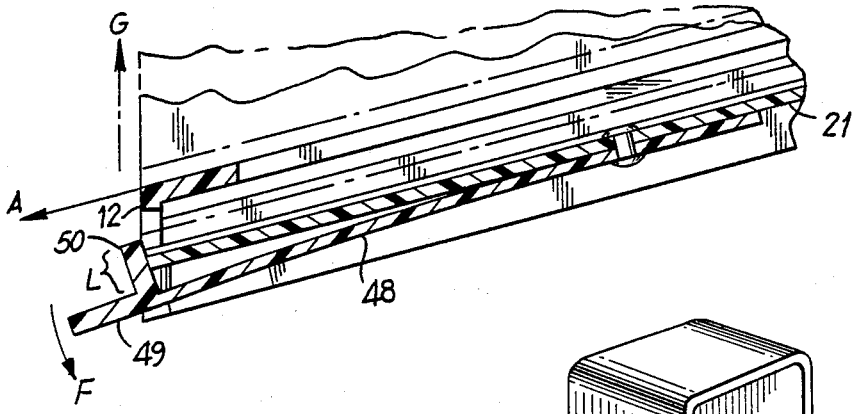
FIG. 6 is a cross-sectional view taken along arrows 6—6 in FIG. 2.

Specifically, as illustrated in FIG. 6, a lock in the form of an arm 48 is attached by glue, a screw or the like to the lower surface of bottom wall 14 and extends forwardly of base 21 to present a manually depressable free end 49. Free end 49 may be manually depressed in the direction of arrow F in FIG. 6. A tab 50 upwardly extending from free end 49 has a length L greater than the predetermined clearance distance D. Thus, at a first, undepressed position of free end 49, shown in solid lines in FIG. 4, tab 50 extends along and engages front wall 12 along a first distance greater than the predetermined clearance distance D. Correspondingly, at a second, depressed position of free end 49, shown in phantom in FIG. 4 and in solid lines in FIG. 6, tab 50 extends along and engages front wall 12 along a second distance, illustrated in FIG. 6, less than the predetermined clearance distance D. Thus although tab 50 may be depressed to its second, lower position, the top of tab 50 extends above the lower front corner of compartment 11 where front wall 12 meets bottom wall 14, and so continues to hold compartment 11 in place. However, with tab 49 depressed to its second position, compartment 11 may be manually lifted by the predetermined clearance distance D in the direction of arrow G of FIG. 6 to lift its front forward corner above the top of tab 50. The advantage is thus that when rack 10 is in place in a commercial setting and a child or other unauthorized operator depresses free end 49, compartment 11 is not disengaged from base 21, but rather is only disengagable therefrom. It is unlikely that such an unauthorized operator will think to thereafter manually lift compartment 11, and so the display will be undisturbed.

Although in the above-described embodiment the foremost position has been identified as the dispensing position, it will be clear that when the articles are stacked on a slope, rather than vertically, any of the articles may be removed from rack 10 from any position within channels 18*a*–18*i*. Indeed, when the articles are provided in boxes, as are toothbrushes, the sloped columns of articles will present a visually pleasing stepped array, and any of the articles may be easily grasped and removed.

In addition, although the preferred embodiment has been described as presenting articles vertically or on a slope, it will be understood that rack 10 may present the articles horizontally, with pushers 20*a*–20*i* urging the articles in the forward direction against friction.

Although a single preferred embodiment of the invention has been described above with reference to the accompanying drawings, it will be apparent that many modifications and variations could be effected therein by one skilled in the art without departing from the spirit or scope of the invention as defined in the appended claims.

What is claimed is:

1. Apparatus for dispensing articles comprising: a substantially rectangular compartment having front, rear, bottom and opposed side walls;

at least one divider wall section extending longitudinally between said front and rear walls for dividing said compartment into a plurality of longitudinal channels;

a longitudinal slot in each of said channels extending through said bottom wall; and pusher means movable longitudinally in each of said channels for urging articles within the respective one of said channels in a forward direction towards said front wall;

each said pusher means including an upper pusher body within the respective channel adapted to bear against a rearmost article in said channel and having a lower surface, a lower foot portion below said bottom wall having an upper surface spaced from said lower surface of said pusher body by a distance greater than a thickness of said bottom wall, a connecting element extending through the respective slot for connecting said pusher body and said foot portion and biasing means for urging said pusher means in said forward direction and acting above said lower surface thereof to tip said pusher body and thereby bring a rear portion only of said foot portion into substantially line contact with said bottom wall.

2. Apparatus according to claim 1, wherein each said foot portion is a substantially rectangular plate having a longitudinal dimension at least as large as a longitudinal dimension of the respective pusher body.

3. Apparatus according to claim 1, wherein said biasing means includes a spring roll for each said pusher means having a coiled portion within the respective pusher body and an end attached to said compartment at the front of the respective channel.

4. Apparatus according to claim 3, wherein said foot portion is a substantially rectangular plate and said connecting means rigidly connects said foot portion and said pusher body, said pusher body being tipped forward by said biasing means to thereby tip said foot portion and bring said rear portion into said substantially line contact against said bottom wall.

5. Apparatus according to claim 1, further comprising a lower support base on which said compartment is mounted at a predetermined position for sliding movement in said forward direction therefrom, and latch means for holding all of said pusher means fixed relative to said base during sliding movement of said compartment.

6. Apparatus according to claim 5, wherein said latch means includes a latch element extending upwardly from said base at positions corresponding to a respective one of said foot portions and engaging the respective foot portion to prevent forward movement thereof relative to said base.

7. Apparatus according to claim 5, further comprising a lock means for engaging said compartment to said base at said predetermined position, said lock means being initially manually actuable to render said compartment disengageable from said base, said compartment being thereafter disengaged from said base by further manual manipulation thereof.

8. Apparatus according to claim 7, wherein said compartment is mounted on said base by guide means permitting said compartment to be manually lifted from said base by a predetermined distance, and wherein said lock means includes an arm attached to said base and having a free end which is manually depressable from a first position adjacent said base to a second position below said base, said arm having an upwardly extending tab engaging a selected wall of said compartment along a first distance greater than said predetermined distance at said first position of said free end, and engaging said selected wall along a second distance less than said predetermined distance at said second position of said free end, whereby upon depression of said free end to said second position said compartment may be manually lifted by said predetermined distance to disengage the same from said base.

9. Apparatus according to claim 1, wherein said divider wall portions are separable from said compartment.

* * * * *